United States Patent [19]

Ebihara

[11] 4,030,338

[45] June 21, 1977

[54] TIMEPIECE TESTING APPARATUS

[75] Inventor: Heihachiro Ebihara, Tokorozawa, Japan

[73] Assignee: Citizen Watch Co., Ltd., Tokyo, Japan

[22] Filed: June 10, 1976

[21] Appl. No.: 694,574

[30] Foreign Application Priority Data

June 12, 1975 Japan ..... 50-71236
July 25, 1975 Japan ..... 50-90860

[52] U.S. Cl. ..... 73/6
[51] Int. Cl.[2] ..... G04B 17/00
[58] Field of Search ..... 73/6; 58/50 R, 85.5; 178/DIG. 36, DIG. 38

[56] References Cited

UNITED STATES PATENTS 3,914,543 10/1975 Kawahare et al. ..... 178/DIG. 36 X
3,978,322 8/1976 Dobkin ..... 73/6 X

*Primary Examiner*—Richard C. Queisser
*Assistant Examiner*—John S. Appleman
*Attorney, Agent, or Firm*—Spensley, Horn and Lubitz

[57] ABSTRACT

An apparatus for testing the accuracy of a timepiece comprising a television camera for converting the time displayed into an electrical signal, a means for converting the electrical signal into a digital signal, and a processing means for storing the digital signal and comparing the digital signal to a signal corresponding to a time standard. In operation, the time displayed on the timepiece is compared to the time standard at two different times and the difference between the time standard and the time displayed of the two measurements is compared.

13 Claims, 8 Drawing Figures

TIMEPIECE TESTING APPARATUS

BACKGROUND OF THE INVENTION

1. Field of the Invention

This invention relates to testing apparatuses for timepieces and more particularly the automatic testing apparatuses for measuring the accuracy.

2 Prior Art

After a timepiece has been assembled, it is frequently necessary to measure the accuracy of the timepiece prior to shipment to the customer. In the prior art exists many means for measuring the accuracy of the timepiece after it has been assembled. In measurements wherein reading of the time display is required, such as direct measurement of daily error, the reading of the display has been made by a human being and then put into test equipment via a keyboard or the time displayed at a prescribed time has been photographed on different days and the difference between the two photographs has been compared visually. Such methods are subject to human error and, in addition, human working efficiency seriously deteriorates after a long period of time.

SUMMARY OF THE INVENTION

It is a general object of the present invention to provide an apparatus for measuring the accuracy of a timepiece which is automatic and therefore eliminates human error.

It is another object of the present invention to provide an apparatus for measuring the accuracy of a timepiece which is reliable.

It is still another object of the present invention to provide an apparatus for measuring the accuracy of a timepiece which is relatively inxpensive.

In keeping with the principals of the present invention, the objects are accomplished by an apparatus for measuring the accuracy of the timepiece including a television camera for converting the time displayed into an electronic signal, a means for converting the electronic signal into a digital signal, a processing means for storing the digital signal and comparing the digital signal to a signal corresponding to a time standard and a control means supplying timing signals for the television camera, the converting means and the processing means. In operation, the time displayed on the timepiece is compared to the time standard at two different times. The difference between the time standard and the time displayed at each time is stored in the processing means. The difference at the two times is then compared to determine the accuracy of the timepiece. In a second embodiment, the control means further includes a means for masking the digital signals applied to the processing means so that only those digital signals corresponding to a significant digital signal are compared. A significant digital signal is one of the minimum number of digital signals which correspond to a point on the display of the timepiece from which the time displayed on the timepiece can be determined.

BRIEF DESCRIPTION OF THE DRAWINGS

The above mentioned and other features and objects of the present invention will become more apparent by reference to the following description taken in conjunction with the accompanying drawings, wherein like reference numerals denote like elements, and in which.

DETAILED DESCRIPTION OF THE INVENTION

Figure 1:
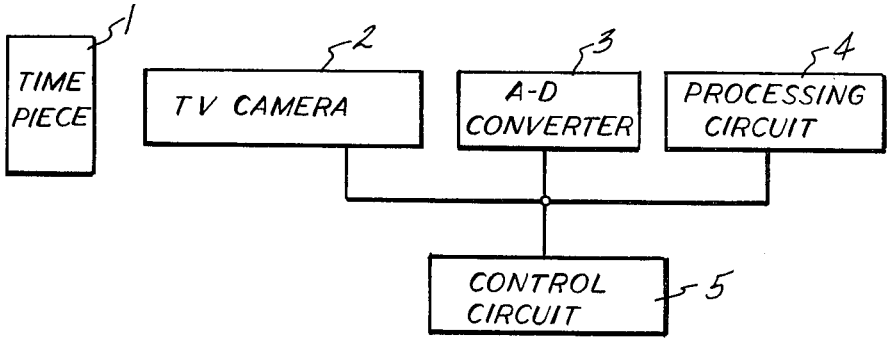
FIG. 1 is a block diagram of an apparatus for measuring the accuracy of a timepiece in accordance with the teachings of the present invention.

Referring to the drawings, in FIG. 1 is shown a block diagram of an apparatus for measuring the accuracy of a timepiece in accordance with the teachings of the present invention. The testing apparatus in FIG. 1 includes a timepiece 1 to be tested, a television camera 2 focused on the time display of the timepiece. A one bit analog to digital (A-D) converter 3 is coupled to the output of television camera 2 and the output of A-D converter 3 is coupled to the input of signal processing means 4. Control means 5 is coupled to television camera 2, A-D converter 3 and processing means 4 and supplies timing signals for same.

Figure 3:
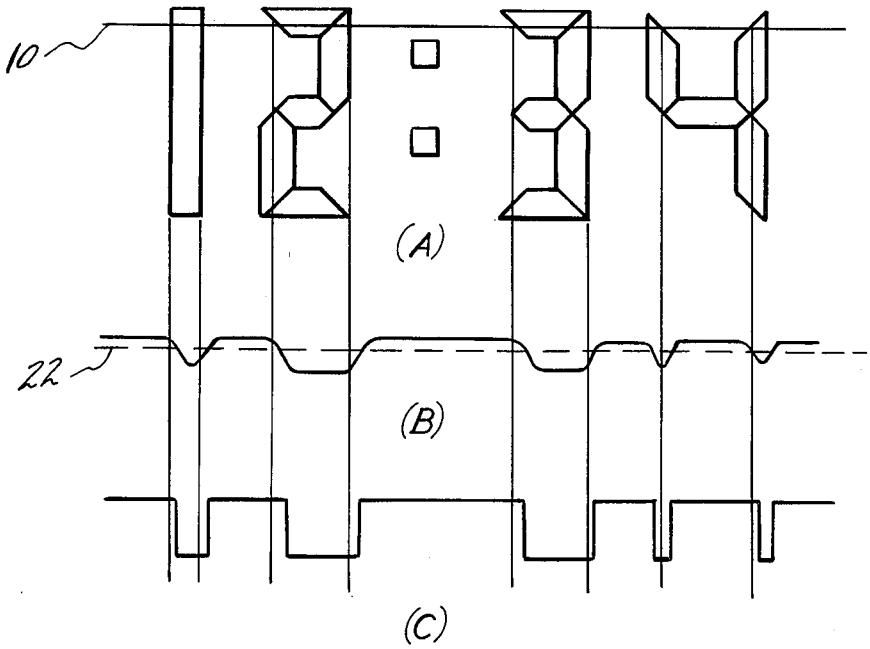
FIG. 3 is a drawing of the time displayed and a graphical representation showing the video signal and the wave form from the converter of FIG. 1.

In operation, the information corresponding to the time displayed on timepiece 1 is converted by television camera 2 into a video signal, as shown in FIGS. 3(*a*) and 3(*b*). In FIGS. 3(*a*) and 3(*b*), when the television camera scans across scan line 10, the video signal takes the form of that shown in FIG. 3(*b*). The video signal from television camera 2 is then converted by A-D converter 3 into a one bit digital signal as shown in FIGS. 3(*a*) and 3(*c*). The digital signal from A-D converter 3 is then fed into processing circuit 4. Also, the position of the scan line of the television camera 2 is identified by the timing signals coming from control circuit 5 and the timing signals coming from control circuit 5 are also supplied to processing means 4 for processing together with the digital signal from A-D converter 3.

In the processing means 4, from the timing signals and the digitized video signal representing the state of the display for each scan line, the time displayed on the timepiece is determined. The time displayed on the timepiece is then compared with a time standard and the difference is calculated and stored in a memory means provided in the processing means 4. At some point in time following the first determination of the difference between the time displayed and the standard time, the same timepiece 1 is brought back to the test apparatus and the difference from the standard time is again determined. This second difference is then compared in the processing means with the previously stored difference and the amount of delay or advance or the timepiece is calculated from the differences from the two tests. The result of the test is utilized as a basis for making various evaluations of the tested timepiece and if an abnormality is detected, an indication is given.

In practice, the testing apparatus of the present invention is capable of being used with either liquid crystal type displays, light emitting diode type displays and analog type displays having hands; but for the purpose of this description, a liquid crystal type display is assumed. Furthermore, the television camera 2 can be any industrial type having a conventional scanning system. In addition processing means 4 may be a digital computer properly programmed or a hard wire special purpose computer. Also, it is within the scope of the present invention that the processing means 4 may comprise a time standard generator, a digital arithmetic means and a storage means properly interconnected. Furthermore, any software or hardware programming of the digital computer is obvious to one skilled in the art and is not a point of novelty of the present invention.

Figure 2:
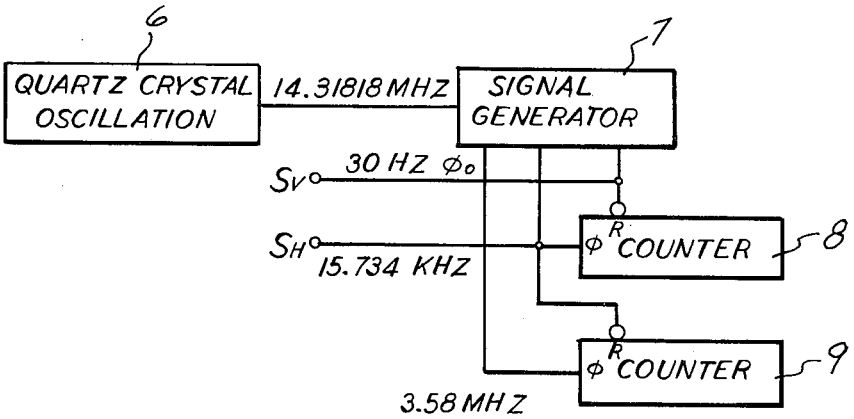
FIG. 2 is a block diagram of the control means of FIG. 1.

Referring to FIG. 2 shown therein is a block diagram of a control means 5 for the embodiment of FIG. 2. The control means 5 of FIG. 2 includes a quartz crystal oscillator 6 which supplies a sinusoidal signal to signal generator 7. The outputs of signal generator 7 are connected to the reset inputs R and clock inputs $\phi$ of counters 8 and 9. The outputs of counter 7 are also applied to the television camera as horizontal synchronization signal $S_H$ and vertical synchronization signal $S_V$.

In operation, quartz crystal oscillator 6 generates a sinusoidal signal (14.31818 $MH_Z$ for industrial television camera) which is applied to the input of signal generator 7. Signal generator 7 digitizes the sinusoidal signal from crystal oscillator 6 and divides the digitized signal in frequency to generate a clock signal $\phi_o$ (which is 3.58 $MH_Z$ in this embodiment), a horizontal synchronization signal $S_H$ (15.734 $KH_Z$) and a vertical synchronization signal $S_V$ (30 $KH_Z$). The clock signal $\phi_o$ is feed into the counter input $\phi$ of counter 9. The horizontal synchronization signal $S_H$ is applied to the television camera and to the reset input of counter 9 and is applied to the counter input $\phi$ of counter 8. The vertical synchronization signal $S_V$ is applied to the television camera as well as to the reset terminal of counter 8. In operation, counter 8 counts the number of horizontal lines to produce output information on the vertical position. Counter 9 counts the number of timing signals and generates information as to horizontal position. The outputs of counters 8 and 9, as information on vertical and horizontal positions, are respectively feed into processing means 4 together with the digitized video information. Furthermore, the counter 8 is reset to zero by the vertical synchronization signal $S_V$ at the beginning of each field and counter 9 is reset to zero by the horizontal synchronization signal $S_H$ at the start of each scanning line. In practice it is possible to change the sharpness of the picture image by changing the number of scanning lines by setting an arbitrary number for the clock signal $\phi_o$.

Figure 5:
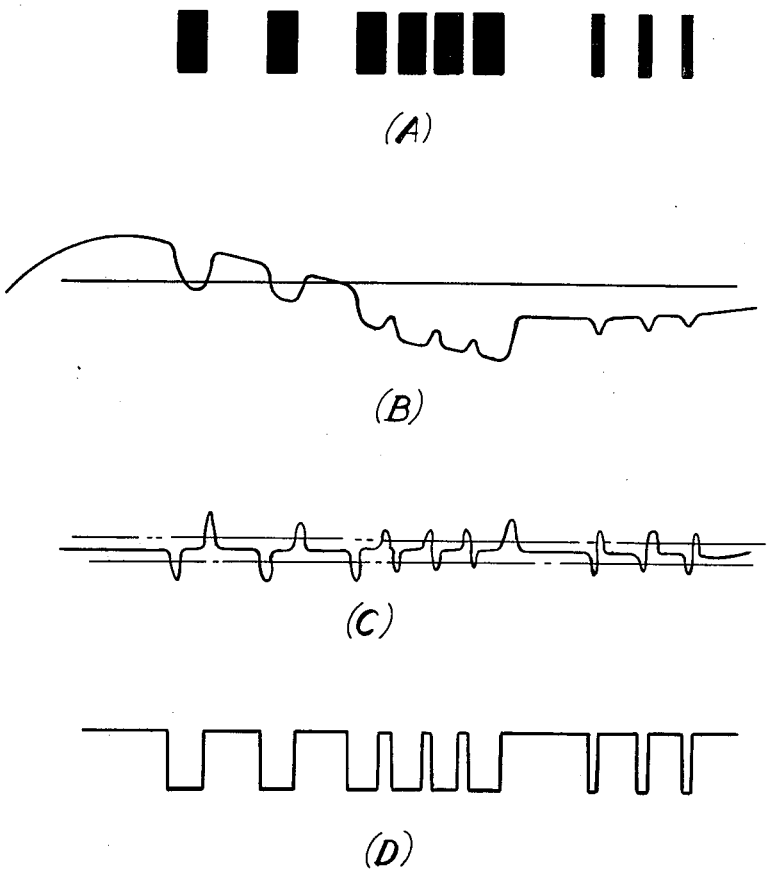
FIG. 5 shows an example of a display pattern and associated wave forms at various points in the testing apparatus.
Figure 6:
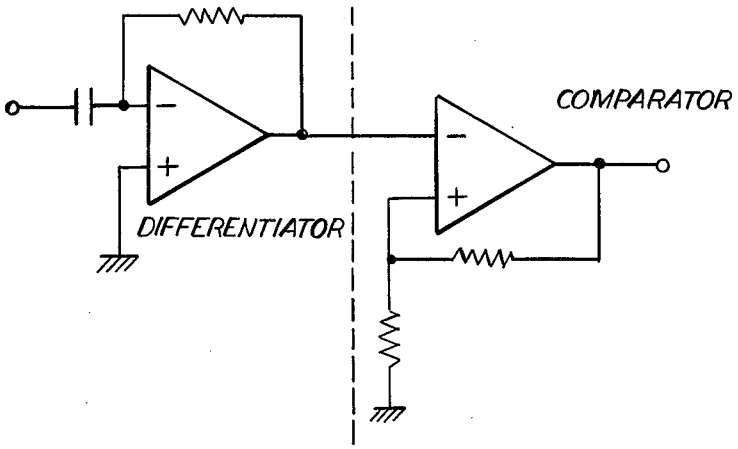
FIG. 6 is a differentiating digitation means utilized in the embodiments of FIGS. 1 and 4.

Referring to FIGS. 3 and 5, in conjunction therewith, a suitable A-D converter is illustrated. FIG. 3 (*a*) shows a display of a digital type timepiece and FIG. 3 (*b*) of said figure is the wave form of the video signal of the television camera 2 that corresponds to the scanning line 10 in FIG. 3(*a*). FIG. 3(*c*) shows a digital signal that is obtained from a one bit A-D conversion of the video signal 3(*b*). Normally in a one bit A-D conversion, it is common practice to set a threshold level 22 as shown by the broken line of FIG. 3(*b*) and to define a logical zero or one below it. However, due to the characteristics of the picture tube, the amplifier circuit and other effects of the television camera, the video signal produced by the television camera 2 may look like that shown in FIG. 5(*b*) for an image shown in FIG. 5(*a*). Consequently, it is not possible to clearly convert the black on white image markings into a one bit code by using the preceeding method. Therefore, in this embodiment, the video signal is digitized by first differentiating it in a differentiator, then feeding the differentiated signal into a comparator that has hystersis or into two comparators with different threshold levels. The differentiated signal corresponding to FIG. 5(*b*) and its digitized signal are shown in FIG. 5(*c*) and 5(*d*) respectively. Examples of the derivative circuit and digitization circuit are shown in FIG. 6, but other types of differentiators or comparators could be used without departing from the spirit and scope of the invention.

As discussed in the foregoing description, the test apparatus of FIG. 1 eliminates the necessity of special operation of the timepiece before a test and also eliminates the necessity for visual readings and human judgment, thus making automatic tests possible and contributing significantly to savings and labor.

Since the A-D converter 3 of the embodiment of FIG. 1 has a resolution capability of four to eight bits and the results of the test are achieved by a processing means 4 that sequentially processes the continuous data from the A-D converters 3, the quantity of data or bits to be processed by the embodiment of FIG. 1 is enormous. Since there is such an enormous amount of information to be processed, a very high speed processing means and a large memory capability are required in the processing means 4, thereby resulting in a very expensive test apparatus. In order to reduce the cost, the amount of data to be processed by the processing means 4 must be reduced. Accordingly, the embodiment of FIG. 4 has been developed.

Figure 4:
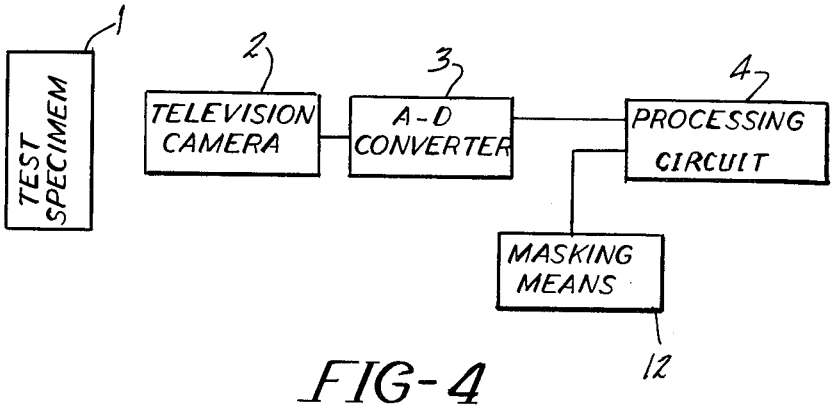
FIG. 4 is a second embodiment of an apparatus for testing the accuracy of a timepiece in accordance with the teachings of the present invention.

Referring to FIG. 4 shown therein is a second embodiment of a test apparatus in accordance with the teachings of the present invention. The test apparatus of FIG. 4 is substantially the same as that shown in FIG. 1 except that a masking means 12 has been provided and coupled to the processing means 4. In FIG. 4, like reference numerals denote like elements to that of FIG. 1. Furthermore, a control means 5 (not shown) is part of the embodiment of FIG. 4.

Figure 7:
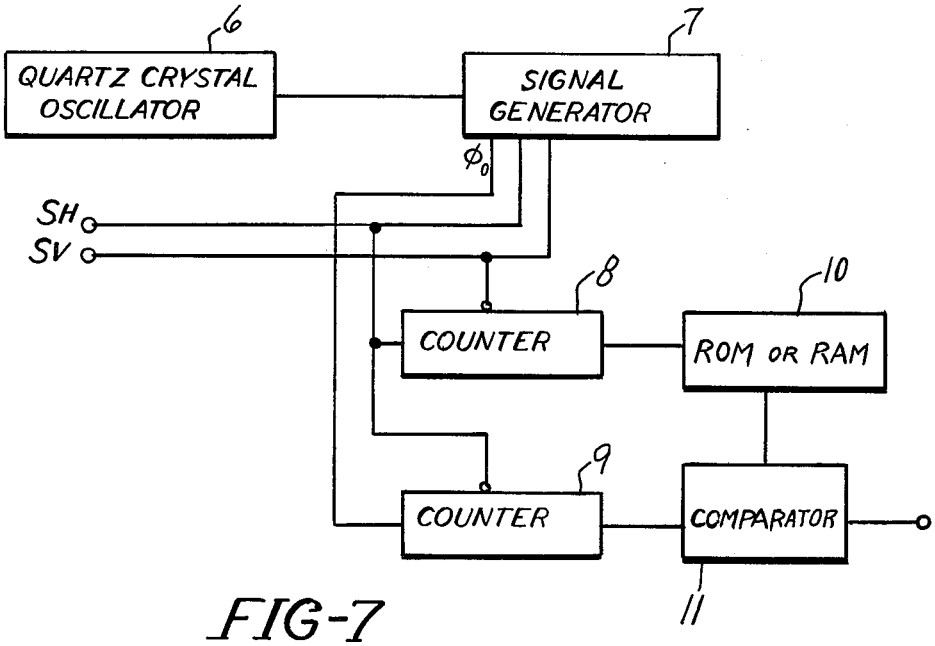
FIG. 7 is a block diagram of a control means including the masking means utilized in the embodiment of FIG. 4.

In a similar manner to that of the embodiment of FIG. 1, the television camera 2 is focused on the test timepiece 1 and the image is converted into a video signal. The video signal from camera 2 is converted into a digital signal by A-D converter 3. A-D converter 3 is a one bit A-D converter. As previously stated in the description of the embodiment of FIG. 1, in addition to the digitized video signal information, information regarding the position in the picture plane are required for processing by the processing means 4. In the embodiment of FIG. 1, this information was supplied by control means 5. In the present embodiment, the positional information is obtained from a control means 5 modified to include the masking function. Such a control means is shown in FIG. 7. In FIG. 7, the control means is substantially the same as that shown in FIG. 3 except that the output of counter 9 is connected to the input of a comparator 11. Furthermore, the control circuit is provided with a read only memory (ROM) or random access memory (RAM) 10 which is connected to an input of the comparator 11.

In operation, the quartz crystal oscillator 6 generates a sinusoidal output signal which is supplied to signal generator 7. Signal generator 7 digitizes the sinusoidal signal from quartz crystal oscillator 6 and divides the signal to generate a clock signal $\phi_o$, a horizontal synchronization signal $S_H$ and a vertical synchronization signal $S_V$. The clock signal $\phi_o$ is feed into counter 9 via its input and the horizontal synchronization signal $S_H$ is feed into the television camera as well as into the reset terminal of counter 9 and into the input terminal of counter 8. Vertical synchronization signal $S_V$ is feed into the vertical synchronization input of the television camera 2 and to the reset terminal of counter 8.

In operation, counter 9 is reset to zero by the horizontal synchronization signal $S_H$ at the beginning of each sweep and counts the clock signals $\phi_o$ to determine the horizontal position of the sweep line at its output. Counter 8 is reset to zero by the vertical synchronization signal $S_V$ at the beginning of each field and produces information on the vertical position in the image plane as its output.

Figure 8:
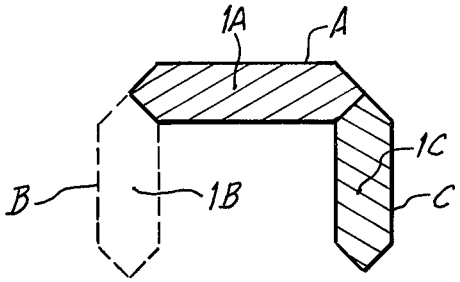
FIG.8 is a portion of the time display and is utilized in the operation of the masking.

By referring to FIG. 8, the operation of the masking means which comprises comparator 11 and ROM or RAM 10 will be explained. As can be seen in FIG. 8, a sufficient amount of information as to the light or dark quality of segment A is given by point 1(A). Likewise, information at points 1(B) and 1 (C) represent the light or dark quality of the segments B and C respectively. Therefore, it should be apparent that only single points in each of the segments are required to determine what the time is. For example, the minimum number of data points required by the procesing means 4 to determine the value of a single digit of a seven segment display is seven data points. In order to supply the required seven data points, in the RAM or ROM 10 is stored the horizontal positions. The input terminal for addressing the horizontal positions stored in the ROM 10 is connected to the output terminal of counter 8. The output of ROM 10 is supplied to comparator 11 wherein it is compared with the output of counter 9 which is supplying horizontal position information. In this way only the data at such points where the output from counter 8 agrees with the output from ROM 10 is processed by the processing means. In other words, only significant digital signals are processed by processing means 4. In this way the amount of data handled by the processing means 4 is drastically reduced.

It should be apparent to one skilled in the art that the processing means 4 in the embodiment of FIG. 7 is substantially the same as the processing means of FIG. 1 except that it is substantially simpler. Furthermore, it should be apparent to one skilled in the art that if one desires to select more than a single data point from each scanning line, a parallel arrangement of two or more ROM's could be implemented.

As disclosed hereinabove, the invention permits a great simplification of the processing means 4 and accordingly drastically reduces the costs of the testing apparatus thereby reducing the cost of testing.

In all cases it is understood that the above described embodiments are merely illustrative of but a few of the many possible specific embodiments which represent the applications or the principals of the present invention. Furthermore, numerous and varied other arrangements can be readily devised in accordance with the principles of the present invention by those skilled in the art without departing from the spirit and scope of the invention.

What is claimed is:

1. An apparatus for testing the accuracy of a timepiece comprising:

a television camera for converting the time displayed on said timepiece into an electrical signal;

a means for converting the electrical signal into a digital signal; and a processing means for determining the time displayed on the timepiece from the digital signal and for comparing the displayed time to a time standard.

2. An apparatus for testing the accuracy of a timepiece according to claim 1 wherein said processing means further determines a difference between the displayed time and the time standard and stores the difference.

3. An apparatus for testing the accuracy of a timepiece according to claim 2 further comprising a control means for supplying timing signals to said television camera, converting means, and processing means.

4. An apparatus for testing the accuracy of a timepiece according to claim 3 wherein said control means comprises a means for generating a clock pulse, a horizontal synchronization signal of a predetermined pulse frequency and a vertical synchronization signal of a predetermined pulse frequency and a means for counting the number of clock pulses and the number of horizontal synchronization signal pulses and for applying said counts to said processing means.

5. An apparatus for testing the accuracy of a timepiece according to claim 1 wherein said converting means comprises an analog to digital converter.

6. An apparatus for testing the accuracy of a timepiece according to claim 5 wherein said analog to digital converter comprises a differentiator and a comparator having hysteresis.

7. An apparatus for testing the accuracy of a timepiece according to claim 1 further comprising a masking means for masking the digital signals applied to said processing means such that only significant digital signals are processed by the processing means.

8. An apparatus for testing the accuracy of a timepiece according to claim 7 wherein said converting means comprises an analog to digital converter.

9. An apparatus for testing the accuracy of a timepiece according to claim 8 wherein said analog to digital converter comprises a differentiator and a comparator having hysterises.

10. An apparatus for testing the accuracy of a timepiece according to claim 9 wherein said control means comprises a means for generating a clock pulse, a horizontal synchronization signal of a predetermined pulse frequency and a vertical synchronization signal of a predetermined pulse frequency and a means for counting the number of clock pulses and the number of horizontal synchronization signal pulses and for applying said counts to said processing means.

11. An apparatus for testing the accuracy of a timepiece according to claim 10 wherein said masking means comprises a memory means addressed by the count of the horizontal synchronization signal pulses, said memory means containing a plurality of numbers which correspond to the count of said clock pulse which correspond to said significant digital signals and a means for comparing said numbers with the count of said clock pulse.

12. A method for testing the accuracy of a timepiece comprising:

converting the time displayed on said timepiece to an electrical signal with a television camera focused on said timepiece;

converting the electrical signal from said television camera to a digital signal;

determining the time displayed on said timepiece from said digital signal;

comparing the determined time displayed with a time standard to determine the difference between the time displayed and the time standard; and storing the difference between the time displayed and the time standard.

13. A method for testing the accuracy of a timepiece according to claim 12 further comprising the step of masking the digital signals such that the time displayed is determined from only significant digital signals.

* * * * *